US008844405B2

(12) United States Patent
Colgan

(10) Patent No.: US 8,844,405 B2
(45) Date of Patent: Sep. 30, 2014

(54) BOTTLE CAP OPENING SYSTEM

(71) Applicant: Jack Wayne Colgan, Safety Harbor, FL (US)

(72) Inventor: Jack Wayne Colgan, Safety Harbor, FL (US)

( * ) Notice: Subject to any disclaimer, the term of this patent is extended or adjusted under 35 U.S.C. 154(b) by 0 days.

(21) Appl. No.: 14/095,996

(22) Filed: Dec. 3, 2013

(65) Prior Publication Data

US 2014/0157958 A1 Jun. 12, 2014

Related U.S. Application Data

(60) Provisional application No. 61/733,963, filed on Dec. 6, 2012.

(51) Int. Cl.
*B67B 7/44* (2006.01)
*B67B 7/18* (2006.01)

(52) U.S. Cl.
CPC .... *B67B 7/44* (2013.01); *B67B 7/18* (2013.01)
USPC ..... 81/3.09; 81/3.4

(58) Field of Classification Search
USPC ..... 81/3.09, 3.29, 3.4, 3.45; 7/151; D8/18, D8/33, 34, 40
See application file for complete search history.

(56) References Cited

U.S. PATENT DOCUMENTS

| | | | | | |
|---|---|---|---|---|---|
| 814,834 | A * | 3/1906 | Coughlin | 81/3.45 |
| 2,568,612 | A * | 9/1951 | Cullen | 30/450 |
| D249,452 | S * | 9/1978 | Gendron | D8/40 |
| D273,555 | S * | 4/1984 | Tanner | D8/40 |
| 4,455,894 | A * | 6/1984 | Roberts | 81/3.09 |
| 4,507,988 | A * | 4/1985 | LoFaso et al. | 81/3.09 |
| 4,723,465 | A * | 2/1988 | Hughes | 81/3.09 |
| 4,846,024 | A * | 7/1989 | Bryant et al. | 81/3.09 |
| 4,911,038 | A * | 3/1990 | Ferrin | 81/3.09 |
| D339,274 | S * | 9/1993 | Alpers | D8/43 |
| 5,388,297 | A * | 2/1995 | Ross | 7/156 |
| D496,570 | S * | 9/2004 | Wolf | D8/40 |
| 7,004,049 | B2 * | 2/2006 | So et al. | 81/3.09 |
| D541,122 | S * | 4/2007 | Chaconas | D8/40 |
| 8,544,128 | B1 * | 10/2013 | Jones et al. | 7/151 |
| 2005/0252343 | A1 * | 11/2005 | Turner | 81/3.09 |
| 2007/0089569 | A1 * | 4/2007 | Hernandez, Jr. | 81/3.09 |
| 2008/0011127 | A1 * | 1/2008 | Mazur | 81/3.09 |
| 2011/0239502 | A1 * | 10/2011 | Gladman | 40/541 |
| 2013/0098210 | A1 * | 4/2013 | Bartz | 81/3.4 |

* cited by examiner

*Primary Examiner* — David B Thomas
(74) *Attorney, Agent, or Firm* — Sandra L. Layer

(57) ABSTRACT

A bottle cap opening tool for removing an externally knurled interiorly threaded cap from a bottle with an externally threaded opening. The various embodiments having at least one end formed in a generally circular configuration with a central aperture, the interior surface of the central aperture having raised sections adapted to engage the knurled external surface of an internally threaded bottle cap. Each of the preferred embodiments described within can be used alone or in combination with one another.

8 Claims, 6 Drawing Sheets

FIGURE 2
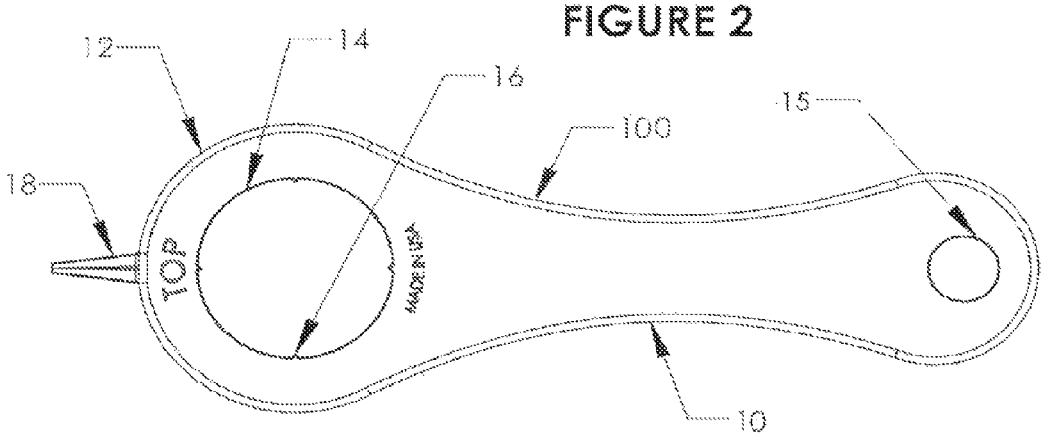
FIGURE 3
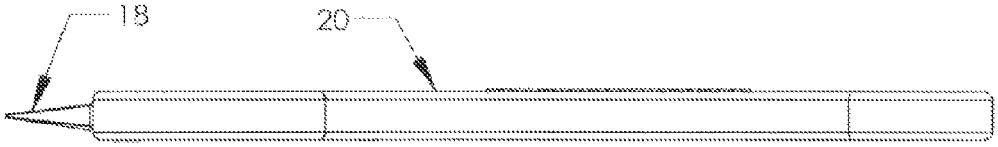
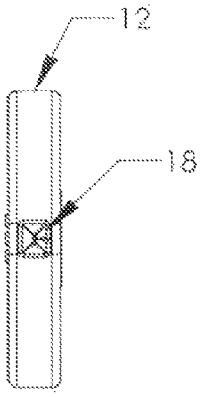
FIGURE 4

BOTTLE CAP OPENING SYSTEM

RELATED APPLICATION

The present patent application claims priority to the corresponding provisional patent application Ser. No. 61/733,963, entitled "Bottle Cap Opening System" filed on Dec. 6, 2012.

BACKGROUND OF THE INVENTION

1. Field of the Invention

The present invention relates to a Bottle Cap Opening System and more particularly pertains to the use of a cap "tool" to gain a mechanical advantage to open and retighten "standard" twist type caps with externally knurled surfaces such as those commonly used in ophthalmic solutions and nutritional drinks.

2. Description of the Prior Art

The use of bottle openers is known in the prior art. More specifically, bottle openers previously devised and utilized for the purpose of opening twist type caps are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,924,579 issued Mar. 16, 1932 to Waterhouse relates to a Rubber Cap-wrench and U.S. Pat. No. 7,267,031 issued Sep. 11, 2007 to Burton and Burton and relates to a Bottle Cap Remover.

While these devices fulfill their respective, particular objectives and requirements, the aforementioned patents do not describe Bottle Cap Opening System that provides a mechanical advantage to open and retighten "standard" twist type caps with externally knurled surfaces such as those commonly used in ophthalmic solutions and nutritional drinks.

In this respect, the Bottle Cap Opening System according to the present invention substantially departs from the conventional concepts and designs of the prior art, and in doing so provides an apparatus primarily developed for the purpose of providing a mechanical advantage to open and retighten "standard" twist type caps with an externally knurled surface. Therefore, it can be appreciated that there exists a continuing need for a new and improved Bottle Cap Opening System which can be used to provide a mechanical advantage to open and retighten "standard" twist type caps with externally knurled surface. In addition, there exists a continuing need for new and improved Bottle Cap Opening System which can be used to provide a mechanical advantage to remove the safety packaging often covering the top portion of a standard twist type bottle cap and bottle. In these regards, the present invention substantially fulfills these needs.

SUMMARY OF THE INVENTION

In view of the foregoing disadvantages inherent in the known types of bottle cap openers now present in the prior art, the present invention provides an improved Bottle Cap Opening System. As such, the general purpose of the present invention, which will be described subsequently in greater detail, is to provide a new and improved Bottle Cap Opening System and method which has all the advantages of the prior art and none of the disadvantages.

To attain this, the present invention essentially comprises a A bottle cap opening tool for grasping and twisting an externally knurled interiorly threaded cap from a bottle with an externally threaded opening, the grasping and twisting being done in a safe, efficient, convenient and economical manner. The system comprises, in combination, a main body portion with at least one end formed in a generally circular configuration, having a central aperture. The central aperture having an interior surface in a frusto-conical configuration with an upper edge and a lower edge with a central axis between the upper and lower edges. The interior surface of the central aperture forms an angle with respect to the central axis and is adapted to contact a threaded bottle using at least one raised section extending radially from the interior surface. The raised sections is adapted to engage the ridges on the exterior surface of an externally knurled cap of a bottle, gripping with respect to the bottle to be opened to facilitate twisting and removal. The main body portion has a central section extending laterally from the proximal section to the distal section forming a handle with generally concave sides. The handle is of sufficient length as to provide leverage when twisting a cap. The bottle Cap System is integrally molded of a rigid material.

Another feature of the invention is to provide a bottle opening system to facilitate the easy removal of a plastic safety wrap seal from a bottle and cap. The present invention has a sharp pointed protrusion extending radially from the exterior perimeter of the proximal end. This protrusion can be used to pierce the plastic safety wrap often encasing the cap and bottle top in order to facilitate removal of the plastic safety wrap.

It is another feature of the invention to provide a surface adapted to allow for the printing of indicia for advertising and marketing purposes.

An additional feature of the invention is a small aperature formed in the distal end of the handle for the purpose of hanging or attaching to a recipient member such as a key ring or a lanyard.

An additional feature of the invention is to provide a bottle opening system with two or more annular heads having interior ridges adapted to engage the ridges of various sized caps.

Another feature of the invention is to provide a bottle cap opening system having interior ridges of different shapes and sizes to engage alternately sized and shaped knurls of bottle cap surfaces.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Each of the features of the preferred embodiments described herein can be used alone or in combination with one another.

Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Bottle Opening System which has all of the advantages of the prior art and none of the disadvantages.

It is another object of the present invention to provide a new and improved Bottle Opening System which may be easily and efficiently manufactured and marketed.

It is further object of the present invention to provide a new and improved Bottle Opening System which is of durable and reliable constructions.

An even further object of the present invention is to provide a new and improved Bottle Opening System which is susceptible of a low cost of manufacture with regard to both materials and labor, and which accordingly is then susceptible of low prices of sale to the consuming public, thereby making such Bottle Opening System economically available to the buying public.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top view of a Bottle Cap Opening System constructed in accordance with the principles of the present invention.

FIG. 3 is a side view of a Bottle Cap Opening System constructed in accordance with the principles of the present invention.

FIG. 4 is an end view of a Bottle Cap Opening System constructed in accordance with the principles of the present invention.

The same reference numerals refer to the same parts throughout the various Figures.

DESCRIPTION OF THE PREFERRED EMBODIMENTS

Figure 1:
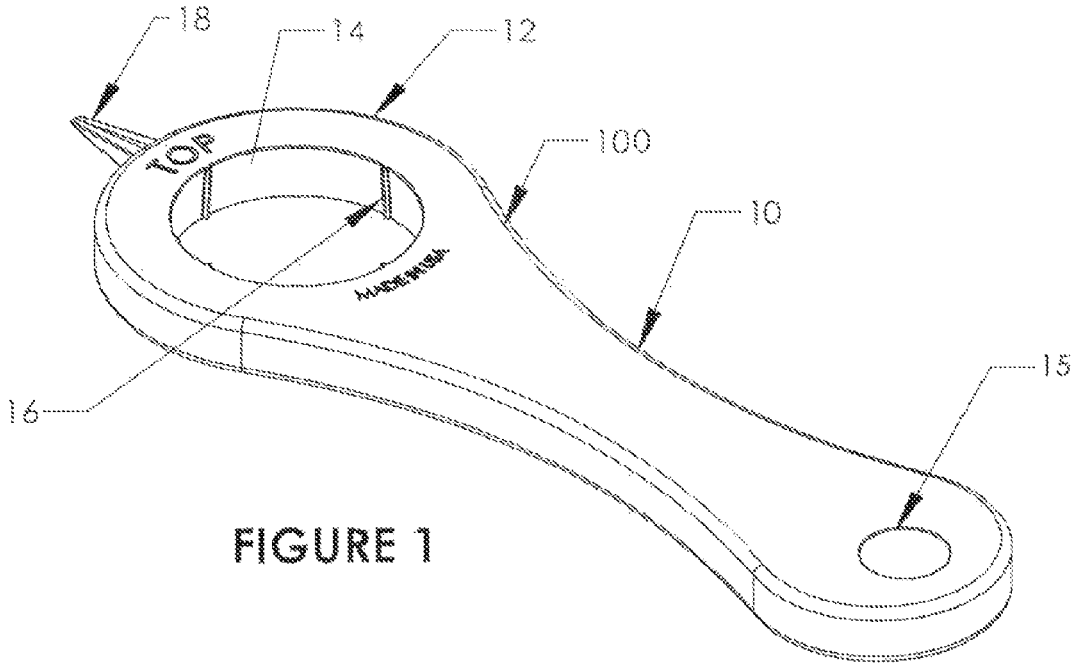
FIG. 1 is an isometric view of a Bottle Cap Opening System constructed in accordance with the principles of the present invention.

With reference now to the drawings, and in particular to FIGS. 1-4 thereof, the preferred embodiment of the new and improved Bottle Cap Opening System embodying the principles and concepts of the present invention and generally designated by the reference numeral 100 will be described.

In the preferred embodiment of the Bottle Cap Opening System, designated by reference numeral 100, first provided is a bottle cap opening tool for grasping and twisting an internally threaded cap with an externally knurled surface from an ophthalmic solution bottle with an externally threaded opening, the grasping and twisting being done in a safe, efficient, convenient and economical manner. The system comprising in combination, a main body portion 100 with a proximal section 12 and a distal section. The proximal section 12 is formed in a generally circular configuration. A central aperture passes through the proximal section. The central aperture has an interior surface 14 in a frusto-conical configuration. The central aperture has an upper edge and a lower edge with a central axis between the upper and lower edges. The interior surface 14 of the central aperture forms an angle with respect to the central axis. The interior surface 14 of the central aperture is adapted to contact a threaded bottle cap to facilitate gripping and twisting with respect to the bottle. The central aperture has at least four raised sections 16 extending radially from the interior surface. The raised sections 16 are equally spaced circumferentially, each raised section in the shape of an equilateral triangle with a height of 0.01285 inches, plus or minus 20 percent and are adapted to contact the externally knurled cap of a bottle to be opened to facilitate twisting and removal. The proximal section has a sharp pointed protrusion 18 extending radially from the exterior perimeter to act as a "stripper tip" to enable the removal of the safety seal which surrounds the cap and bottle area.

The main body portion has a central section 10 extending laterally between the proximal section and the distal section forming a handle. The handle is formed with generally concave sides. The distal section is formed in a generally circular configuration. A minor aperture 15 passes through the central extent of the distal end for the purpose of hanging or connecting to a recipient member such as a key ring or lanyard. The length of the handle being a minimum of 0.75 inches with a height of 0.187 inches plus or minus 10 percent between the upper and lower edges. A pad printable area is located in the central portion of the length of the handle.

The length of the main body portion including the proximal end and the distal end is between 1.75 and 3.5 inches;

The main body portion including the proximal end and the distal end is integrally molded of a rigid material chosen from the class of rigid materials including polymer, plastic and composite.

Figure 5:
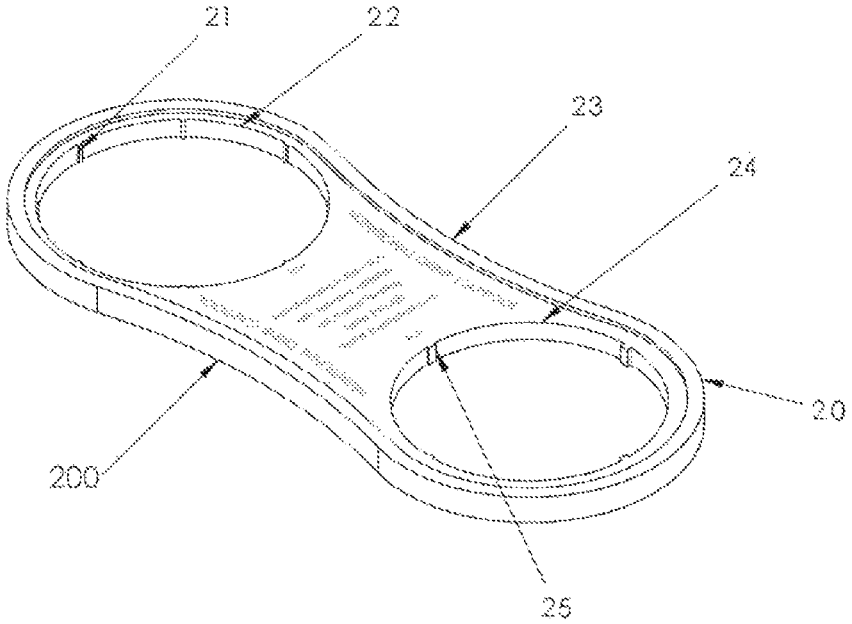
FIG. 5 is an isometric view of an alternate embodiment of a Bottle Cap Opening System constructed in accordance with the principles of the present invention.
Figure 6:
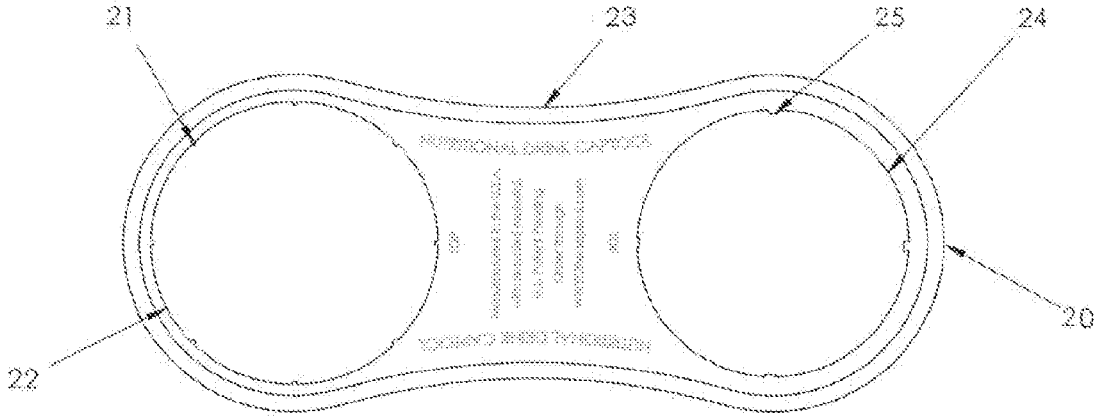
FIG. 6 is a top view of an alternate embodiment of a Bottle Cap Opening System constructed in accordance with the principles of the present invention.
Figure 7:
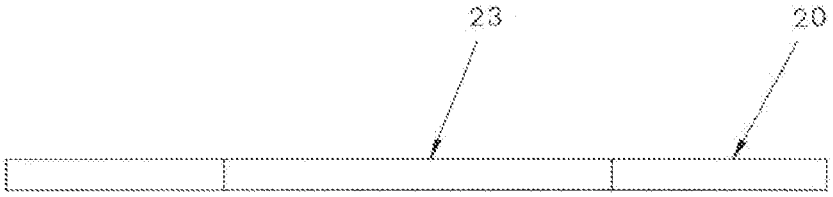
FIG. 7 is a side view of an alternate embodiment of a Bottle Cap Opening System constructed in accordance with the principles of the present invention.
Figure 8:
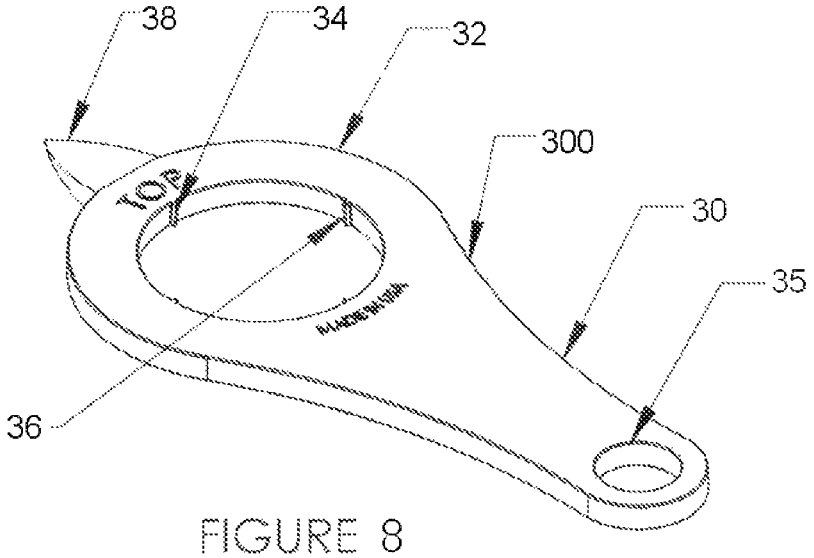
FIG. 8 is an isometric view of an alternate embodiment of a Bottle Cap Opening System constructed in accordance with the principles of the present invention.
Figure 9:
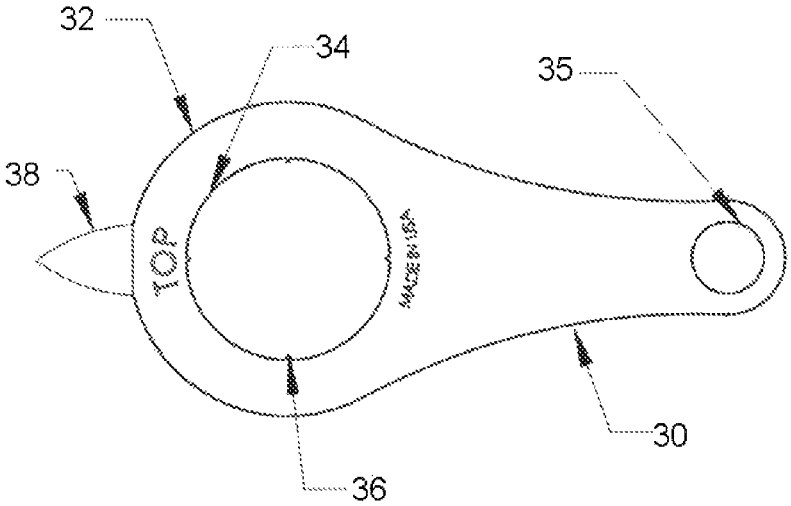
FIG. 9 is a top view of an alternate embodiment of a Bottle Cap Opening System constructed in accordance with the principles of the present invention.
Figure 10:
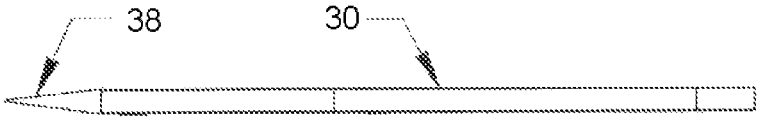
FIG. 10 is a side view of an alternate embodiment of a Bottle Cap Opening System constructed in accordance with the principles of the present invention.
Figure 11:
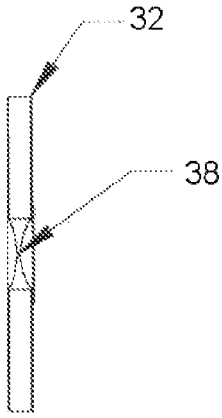
FIG. 11 is an end view of an alternate embodiment of a Bottle Cap Opening System constructed in accordance with the principles of the present invention.

The invention also includes an alternate embodiment of the invention as shown in FIGS. 5 through 7. The alternate embodiment comprises a main body portion 200 having a distal end and proximal end. The proximal end comprised of an annular end with an interior surface 12 in a frusto-conical configuration. The interior surface of the central aperture forms an angle with respect to the central axis. The interior surface 22 of the central aperture is adapted to contact a threaded bottle cap to facilitate gripping and twisting with respect to the bottle. The central aperture has at least four raised sections 21 extending radially from the interior surface. The raised sections 21 are equally spaced circumferentially, each raised section in the shape of triangle and are adapted to contact the externally knurled cap of a nutritional drink bottle to be opened to facilitate twisting and removal. The main body portion 200 having a central section 23 extending laterally from the proximal section to the distal section forming a handle, the handle having a length and a height, the handle being formed with generally concave sides and having a pad printable area;

The distal end 20 having a second annular end formed in the same general frusto-conical configuration as the proximal end with at least four raised sections 25 extending radially from the interior surface. The raised sections 25 are equally spaced circumferentially, each raised section in the shape of a rectangle and are adapted to contact the externally knurled cap of a nutritional drink bottle to be opened to facilitate twisting and removal. The distal end having a having a different diameter adapted to contact a threaded bottle cap of an alternate size to facilitate gripping and twisting with respect to the bottle. The main body portion including the proximal section and the distal section has a length of between 4.5 and 5.5 inches.

The invention also includes a third alternate embodiment of the invention as shown in FIGS. 8 through 11. The third alternate embodiment has a main body portion 300 with a proximal end and a distal end. The proximal section 32 is formed in a generally circular configuration. A central aperture passes through the proximal section. The central aperture has an interior surface 34 in a frusto-conical configuration. The central aperture has an upper edge and a lower edge with a central axis between the upper and lower edges. The interior surface of the central aperture forms an angle with respect to the central axis. The interior surface 34 of the central aperture is adapted to contact a threaded bottle cap to facilitate gripping and twisting with respect to the bottle. The central aperture has at least four raised sections 36 extending radially from the interior surface. The raised sections 36 are equally spaced circumferentially, each raised section 36 in the shape of an equilateral triangle with a height of 0.01285 inches, plus or minus 20 percent and are adapted to contact the externally knurled cap of a bottle to be opened to facilitate twisting and removal. The proximal section 32 has a sharp pointed protrusion 38 extending radially from the exterior perimeter to act as a "stripper tip" to enable the removal of the safety seal which surrounds the cap and bottle area.

The main body portion has a central section extending laterally between the proximal section and the distal section forming a handle 30. The handle 30 is formed with generally concave sides. The main body portion has a distal section. The distal section is formed in a generally circular configuration. A minor aperture 35 passes through the central extent of the distal end for the purpose of hanging or connecting to a recipient member such as a key ring or lanyard. A pad printable area is located in the central portion of the length of the handle. The main body has a height of less than 0.1 inches and a length including the proximal end and the distal end of between 2.5 and 2.75 inches.

The main body portion including the proximal end and the distal end is integrally molded of a rigid material chosen from the class of rigid materials including polymer, plastic and composite.

An additional alternate embodiment is comprised of a main body portion having a proximal and distal end. The length of the main body being formed with multiple aperatures with decreasing diameters, each aperature with an interior surface formed in a frusto-conical configuration and including at least one raised section extending radially from the interior surface for the purpose of engaging the ridges on the exterior surface of a bottle cap. The interior surface of the various apertures having varying angles with respect to the central axis to align with draft of the external surface of various sized bottle caps. The proximal end has a pointed tip extending radially from the exterior surface of the proximal end for the purpose of piercing and removing a plastic safety seal which surrounds the cap and top portion of a bottle.

The Bottle Cap Opening System was developed as a basic "tool' for enabling one to gain a mechanical advantage to open "standard" twist caps with externally knurled surfaces such as those used in opthalmalic solutions as well as retightening the same. The "stripper tip" located at the top of the annular end of the tool enables the removal of the safety seal that surrounds the cap and bottle area using a piercing action to "break" the seal allowing for removal. The top surface is adapted to allow for the printing of indicia for advertising and marketing purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A bottle cap opening tool for grasping and twisting an externally knurled interiorly threaded cap from a bottle with an externally threaded opening, the grasping and twisting being done in a safe, efficient, convenient and economical manner, the tool comprising, in combination:

a main body portion with a proximal section and a distal section, the proximal section being formed in a generally circular configuration, having a central aperture passing through the proximal section and the central aperture having an interior surface in a frusta-conical configuration, the central aperture having an upper edge and a lower edge, the central aperture having a central axis between the upper and lower edges, the interior surface of the central aperture forming an angle with respect to the central axis, the interior surface of the central aperture adapted to contact a threaded bottle cap to facilitate gripping and twisting with respect to the bottle, the central aperture having at least four raised sections extending radially from the interior surface, the raised sections being equally spaced circumferentially, the raised sections adapted to contact the externally knurled cap of a bottle to be opened for facilitating twisting and removal;

the main body portion having a central section extending laterally from the proximal section to the distal section forming a handle;

the main body portion including the proximal section, central section and distal section being integrally molded of a rigid material chosen from the class of rigid materials including nylon, plastic and composite;

the main body portion having a distal end formed in a generally circular configuration, the distal section having a central aperture passing through the distal section and with an interior surface in a frusto-conical configuration, the central aperture having an upper edge and a lower edge, the central aperture having a central axis, the interior surface of the central aperture forming an angle with respect to the central axis, the interior surface of the central aperture adapted to contact a threaded bottle cap to facilitate gripping and twisting with respect to the bottle, the central aperture having at least four raised sections extending radially from the interior surface, the raised sections being equally spaced circumferentially, each raised section being formed to contact the externally knurled cap of the bottle to be opened for facilitating twisting and removal.

2. The tool as set forth in claim 1 wherein the raised sections of the central aperture passing through the proximal section are formed in the shape of a triangle.

3. The system tool as set forth in claim 1 wherein the raised sections of the central aperture passing through the proximal section are formed in the shape of a rectangle.

4. The tool as set forth in claim 1 wherein the raised sections of the central aperture of the distal end are formed in the shape of a rectangle.

5. The tool as set forth in claim 1 having a handle being formed with generally concave sides.

6. The tool as set forth in claim 1 having a handle being formed with a pad printable area.

7. A bottle Cap Opening Tool for grasping and twisting an externally knurled interiorly threaded cap from an eye drop bottle with an externally threaded opening, the grasping and twisting being done in a safe, efficient, convenient and economical manner, the tool comprising, in combination:

a main body portion with a proximal section and a distal section, the proximal section formed in a generally circular configuration, the proximal section having a central aperture passing through the proximal section and with an interior surface in a frusto-conical configuration, the central aperture having an upper edge with a diameter of 0.724 inches plus or minus 10 percent, the central aperture having a lower edge, the central aperture having a central axis with a height of 0.187 inches plus or minus 10 percent between the upper and lower edges, the interior surface of the central aperture forming an angle ranging from 1.5 to 20 degrees with respect to the central axis, the interior surface of the central aperture adapted to contact a threaded bottle cap to facilitate gripping and twisting with respect to the bottle, at least four raised sections extending radially from the interior surface, the raised sections being equally spaced circumferentially, each raised section being in the shape of an equilateral triangle with a height of 0.01285 inches, plus or minus 20 percent, the raised sections adapted to contact the externally knurled cap of the eye drop bottle to be opened for facilitating twisting and removal;

the proximal section having a sharp pointed protrusion extending radially from the exterior perimeter to act as a "stripper tip" to enable the removal of a safety seal which surrounds the cap and bottle area;

the main body portion having a central section extending laterally from the proximal section to the distal section forming a handle, the handle having a length between 2 and 2.5 inches and a height of 0.187 inches plus or minus 10 percent between the upper and lower edges, the handle being formed with generally concave sides and having a pad printable area;

the main body portion having a distal end formed in a generally circular configuration, the distal end having an eternal diameter of between 60 and 80 percent of the proximal section of the main body, a distal aperture passing through the central extent of the distal end, the distal aperture having a diameter of 0.25 inches plus or distal 10 percent;

the main body portion including the proximal section, central section and the distal section having a length between 3 and 3.5 inches;

the main body portion including the proximal section and distal section being integrally molded of a rigid material chosen from the class of rigid materials including nylon, plastic and composite.

8. A bottle cap opening tool for grasping and twisting an externally knurled interiorly threaded cap from a bottle with an externally threaded opening, the grasping and twisting being done in a safe, efficient, convenient and economical manner, the tool comprising, in combination:

a main body portion with a proximal section and a distal section, the proximal section formed in a generally circular configuration, the proximal section having a central aperture passing through the proximal section and with an interior surface in a frusto-conical configuration, the central aperture having an upper edge with a diameter of 1.763 inches plus or minus 10 percent, the central aperture having a lower edge, the central aperture having a central axis with a height of 0.19 inches plus or minus 10 percent between the upper and lower edges, the interior surface of the central aperture forming an angle ranging from 1.5 to 20 degrees with respect to the central axis, the interior surface of the central aperture adapted to contact a threaded bottle cap to facilitate gripping and twisting with respect to the bottle, the central aperture having at least four raised sections extending radially from the interior surface, the raised sections being equally spaced circumferentially, each raised section being in the shape of a rectangle, the raised sections adapted to contact the cap of a nutritional drink bottle to be opened for facilitating twisting and removal;

the main body portion having a central section extending laterally from the proximal section forming a handle, the handle having a length and a height, the handle being formed with generally concave sides and having a pad printable area;

the main body portion having a distal end formed in a generally circular configuration, the distal section having a central aperture passing through the distal section and with an interior surface in a frusta-conical configuration, the central aperture having an upper edge, the central aperture having a lower edge, the central aperture having a central axis with a height of 0.19 inches plus or minus 10 percent between the upper and lower edges, the interior surface of the central aperture forming an angle with respect to the central axis, the interior surface of the central aperture adapted to contact a threaded bottle cap to facilitate gripping and twisting with respect to the bottle, at least four raised sections extending radially from the interior surface, the raised sections being equally spaced circumferentially, each raised section being in the shape of a rectangle, the raised sections adapted to contact the externally knurled cap of the bottle to be opened for facilitating twisting and removal;

the main body portion including the proximal section and the distal section having a length between 4.5 and 5.5 inches;

the main body portion including the proximal section and distal section being integrally molded of a rigid material chosen from the class of rigid materials including nylon, plastic and composite.

* * * * *